US005213152A

United States Patent [19]

Cox

[11] Patent Number: 5,213,152

[45] Date of Patent: May 25, 1993

[54] TEMPERATURE CONTROL SYSTEM FOR A HEAT DETECTOR ON A HEAT EXCHANGER

[75] Inventor: William C. Cox, Wellsville, N.Y.

[73] Assignee: ABB Air Preheater, Inc., Wellsville, N.Y.

[21] Appl. No.: 787,941

[22] Filed: Nov. 5, 1991

[51] Int. Cl.[5] ..... F28D 19/04; G01J 5/04

[52] U.S. Cl. ..... 165/5; 165/7; 62/3.3; 62/259.2; 250/352; 250/370.15

[58] Field of Search ..... 165/5, 7; 62/3.3, 259.2; 250/352, 370.15

[56] References Cited

U.S. PATENT DOCUMENTS 4,825,078 4/1989 Huber et al. ..... 252/370.15

*Primary Examiner*—Albert W. Davis, Jr.

*Attorney, Agent, or Firm*—Chilton, Alix & Van Kirk

[57] ABSTRACT

A control system for regulating the temperature of a heat detector disposed on a heat exchanger. The control system includes a temperature detector (42) for determining the temperature of the hot spot sensor (32), non-liquid cooling means (50,52) for cooling the detector when its temperature is above the desired temperature range, and non-liquid heating means (48,53) for heating the detector when its temperature is below the temperatures range. The control system includes control means (82) coupling the temperature sensing means to the non-liquid heating and cooling means. By keeping the heat detector at a generally constant temperature, the accuracy of the hot spot sensor on the heat exchanger is improved.

15 Claims, 5 Drawing Sheets

TEMPERATURE CONTROL SYSTEM FOR A HEAT DETECTOR ON A HEAT EXCHANGER

BACKGROUND OF THE INVENTION

The present invention relates to heat exchangers and more particularly relates to a temperature control system for maintaining a constant temperature in a heat detector of a heat exchanger.

In a rotary regenerative heat exchanger, a mass of heat absorbent material commonly comprised of packed element plates is positioned in a hot exhaust gas passageway to absorb heat from the hot gases passing therethrough. After the plates become heated by the gas they are positioned in a passageway being traversed by cool air where heat is transferred from the heated plates to the cool air or gas flowing therethrough.

The heat-containing gases are typically the exhaust gases from a combustion process. As the hot exhaust gases are directed through the rotary regenerative heat exchanger, fly ash and unburned products of combustion carried by the exhaust gas are deposited on the surface of the packed element plates. The deposits continue to build up until the rate of air and gas flow through the heat exchanger is reduced in at least the region of the build-up. When the temperature is elevated to the ignition point of the deposit, heat is then generated until the deposits begin to glow and cause a "hot spot", that if not detected will rapidly increase in temperature until the metal of the heat exchanger will itself ignite and cause a fire. U.S. Pat. Nos.: 3,730,259; 3,861,458; 4,022,270; 4,383,572 and 4,813,003; the disclosure of each being hereby incorporated by reference, disclose apparatus to detect hot spots in the packed element plates of a rotary regenerative heat exchanger.

Hot spot detectors frequently employ computerized infrared detectors to detect temperature changes within the exchanger. The infrared detectors frequently employ a lead sulfide chip which is itself sensitive to temperature changes. In order to maintain a consistent level of chip sensitivity, a temperature control system is employed to keep the detector at a constant temperature. The detector electronics are then calibrated for that particular temperature of the chip. In the past, the control system for maintaining a constant chip temperature has consisted of cooling water circulated through a jacket in the sensor head assembly. This type of system has been problematic, however, due to water leaks that ruin the detector, a lack of reliability in the water supply, and a variable water temperature. All of these factors lead to a lack of consistency in the temperature of the detector, which can lead to a lack of consistency in the detection of hot spots. Furthermore, while the system can be used to cool the detector, it is not capable of heating the detector.

SUMMARY OF THE INVENTION

An object of the invention is to provide a reliable temperature control system to maintain a constant temperature in a hot spot detector used in a heat exchanger.

Another object of the invention is to provide a temperature control system for a hot spot detector using compressed air and electric cooling and/or heating means.

Yet another object of the invention is to provide an infrared detector that can be kept at a generally constant temperature using a temperature control system that is designed for both heating and cooling.

A further object of the invention is to provide a temperature control system for a hot spot detector which does not require the use of a tightly sealed cooling water jacket around the head assembly.

These and other objects and advantages of the invention are achieved in a broad aspect of the invention, by providing a control system for maintaining the temperature of a heat detector disposed on a heat exchanger within a predetermined temperature range. The control system comprises a temperature sensing means for sensing the temperature of the detector, non-liquid cooling means for cooling the detector to a temperature within the predetermined temperature range, non-liquid heating means for heating the detector to a temperature within the predetermined temperature range, and control means coupling the temperature sensing means to the non-liquid heating means and the non-liquid cooling means. The control means activates the non-liquid cooling means when the temperature of the detector is above the predetermined temperature range, and activates the non-liquid heating means when the temperature of the detector is below the predetermined temperature range. The invention also comprises a method of using the control system described above, and comprises a hot spot detector incorporating the control system.

The invention accordingly consists in the features of construction, combination of elements and arrangement of parts which will be exemplified in the construction hereafter set forth and the scope of the application which will be indicated in the appended claims.

DESCRIPTION OF THE PREFERRED EMBODIMENT

Figure 1:
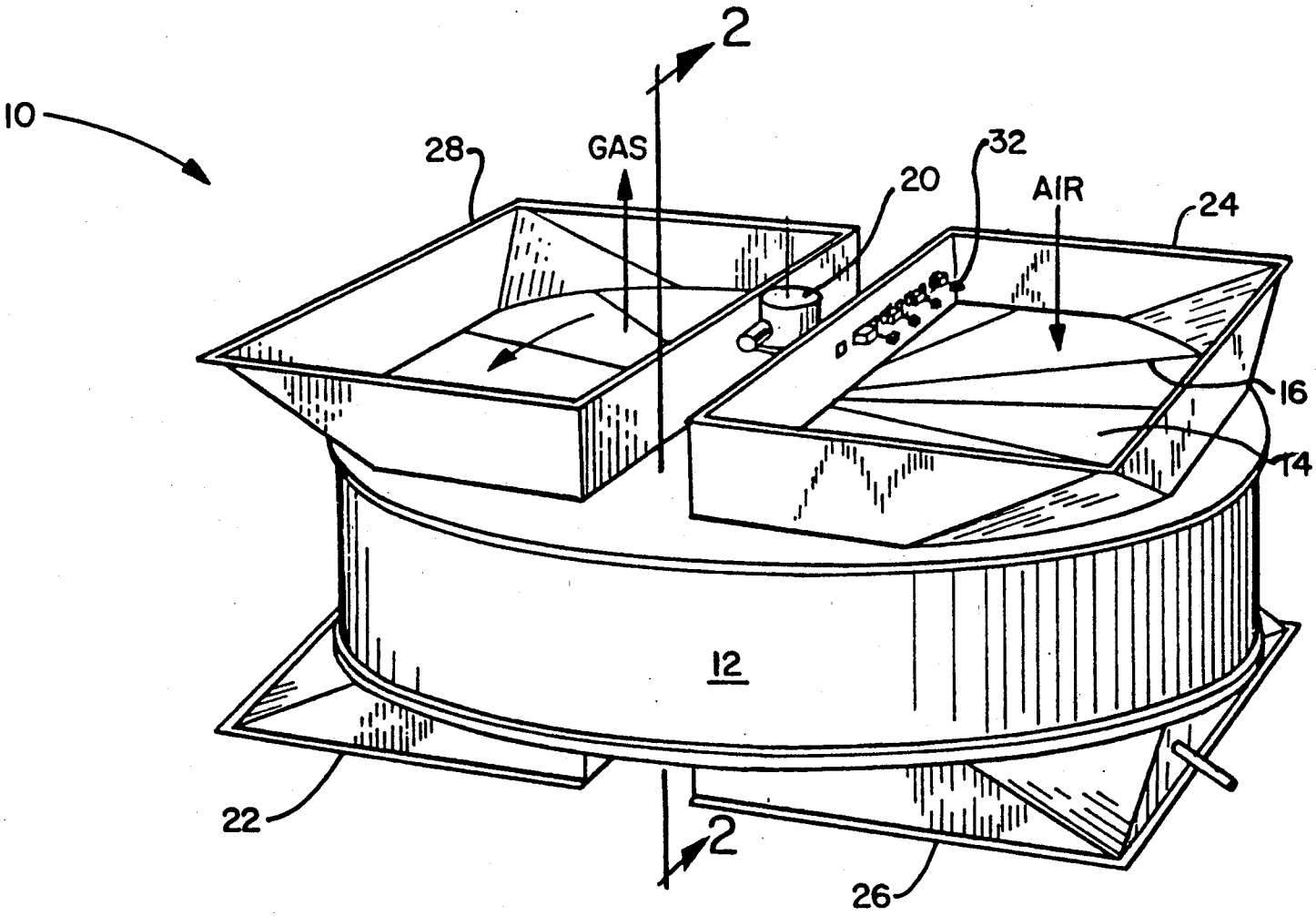
FIG. 1 is a perspective view of a rotary regenerative heat exchanger employing a plurality of heat sensors for detecting hot spots.
Figure 2:
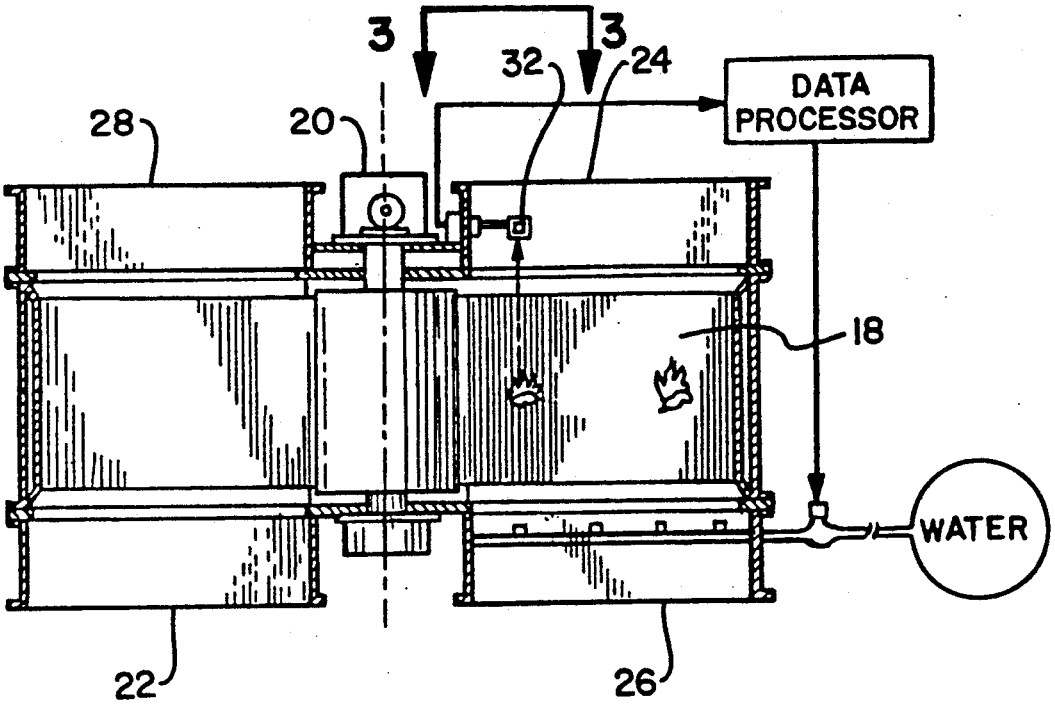
FIG. 2 is an enlarged cross-sectional view showing a heat sensor positioned to receive infrared radiation from the packed element plates.

In FIG. 1, there is depicted a rotary regenerative air preheater 10 having a hot spot detection system designed in accordance with the present invention. The rotary regenerative air preheater 10 is comprised of a cylindrical housing 12 that encloses rotor 14 having a cylindrical casing that includes a series of compartments formed by radial partitions 16 extending between the casing and a central rotor post. The compartments each contain a mass of heat absorbent material, such as corrugated element plates, that provides passageways for the flow of fluid therebetween. Rotor 14 is rotated slowly about its axis by motor 20 to advance heat absorbent material 18, shown in FIG. 2, alternately between a heating fluid and a fluid to be heated. Heat absorbent material 18 absorbs heat from a heating fluid entering duct 22 of air preheater 10, and transfers the absorbed heat to a cooler fluid entering air preheater 10 through cooling fluid entering duct 24. The heated cooler fluid is then discharged from air preheater 1 through cooling fluid exiting duct 26 and transported to a point of use while the cooled heating fluid is discharged through heating fluid exiting duct 28.

Figure 4:
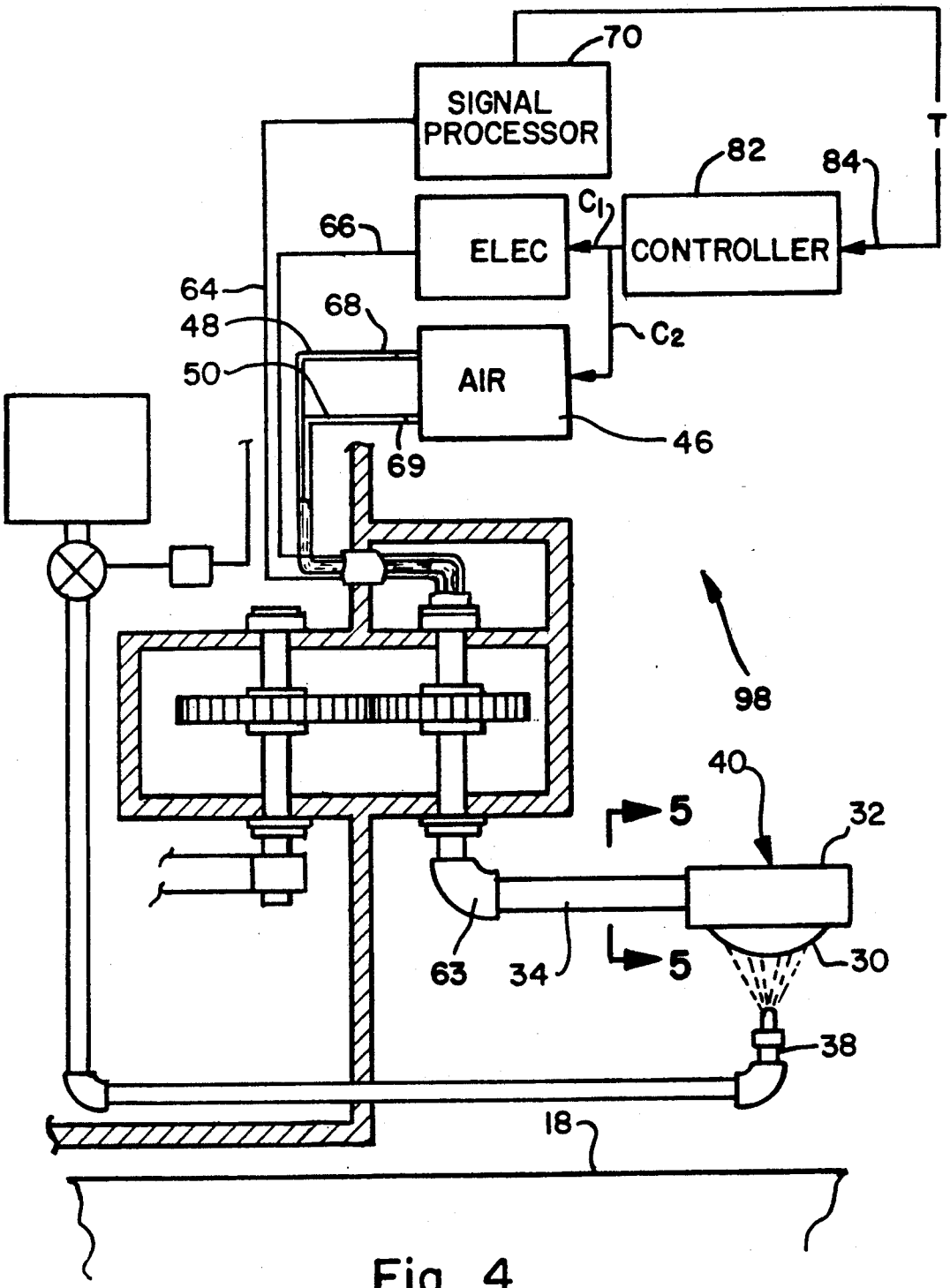
FIG. 4 is a side view, partly schematic, of the inventive temperature control system for the sensors of the type shown in FIGS. 1 and 3.

Instruments have been developed to sense the radiation of infrared rays from heat absorbent material 18 in order to detect incipient fires and to initiate fire control measures within rotor 14 of air preheater 10. The infrared energy emitted by heat absorbent material 18 is collimated in some degree normal to the end surface of rotor 14. With reference to FIG. 4, the emitted infrared radiation that is collimated is focused by lens 30 onto sensor 32. Sensor 32, typically containing a lead sulfide chip 33 which has a resistance that decreases as the amount of infrared energy increases, generates a signal proportional to the infrared radiation incident thereon. The signal generated by sensor 32 is indicative of the temperature of heat absorbent material 18 in the region of rotor 14 where the infrared energy originated. This temperature is indicative of whether a portion of the air preheater has a temperature exceeding a threshold value. Sensors 32 for the detection of infrared radiation emitted from heat absorbent material 18 are typically located in the cooling fluid entering duct 24 through which the cooler fluid entering air preheater 10 passes, but can be located at any position near the heat absorbent material 18. The sensors are typically positioned to scan an arcuate path in a plane parallel and adjacent to the end of rotor 14 in the cleanest and coolest environment. At this location, any ignited deposits creating hot spots will have had maximum exposure to air and hence oxygen and will thereby result in a hot spot at its maximum temperature.

Figure 3:
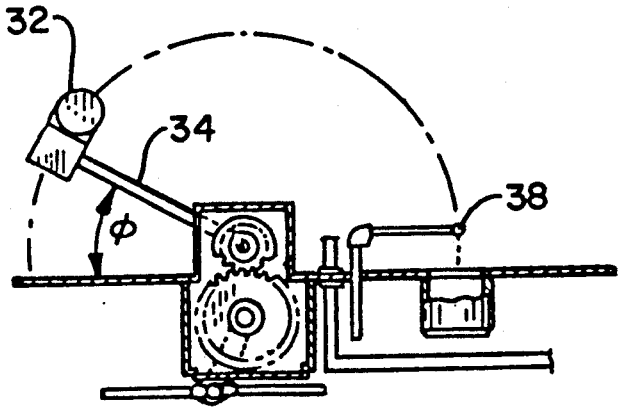
FIG. 3 is a top plan view showing the arcuate path of the heat sensor, taken along line 3—3 in FIG. 2.

One or more sensors 32 traverse cooling fluid entering duct 24 in a plane parallel and adjacent to the end of rotor 14 so that the entire surface of the end face of rotor 14 is viewed as rotor 14 rotates through cooling fluid entering duct 24. Although a sensor 32 may be reciprocated in and out of the rotor shell so as to translate across cooling fluid entering duct 24, it is most common to pivot the sensor 32, which is supported by conduit 34, so that viewing lens 30 moves along an arcuate path as is illustrated in FIG. 3.

In order to maintain viewing lens 30 of sensor 32 at or near its peak of light transmission capability, viewing lens 30 is periodically subjected to a cleaning process that removes deposits of duct therefrom. One such cleaning system is disclosed in U.S. Pat. No. 4,383,572 in which a blast of pressurized cleaning fluid is timed to eject from nozzle 38 over viewing lens 30 as viewing lens 30 comes into direct alignment with nozzle 38. Other lens cleaning processes may be used.

Infrared sensors used for hot spot monitoring in the prior art are typically subjected to a flow of cooling water circulated through a cooling water jacket in a sensor head assembly. Such systems are designed for cooling only, not heating, and are designed to be leakproof at operating pressure. A number of problems associated with such cooling systems include water leaks that ruin the detector, and an unreliable water supply. Furthermore, the plants in which the infrared detector systems are installed supply water at different and variable temperatures. This makes it difficult to keep the detector temperature constant or under a recommended high temperature limit.

Figure 5:
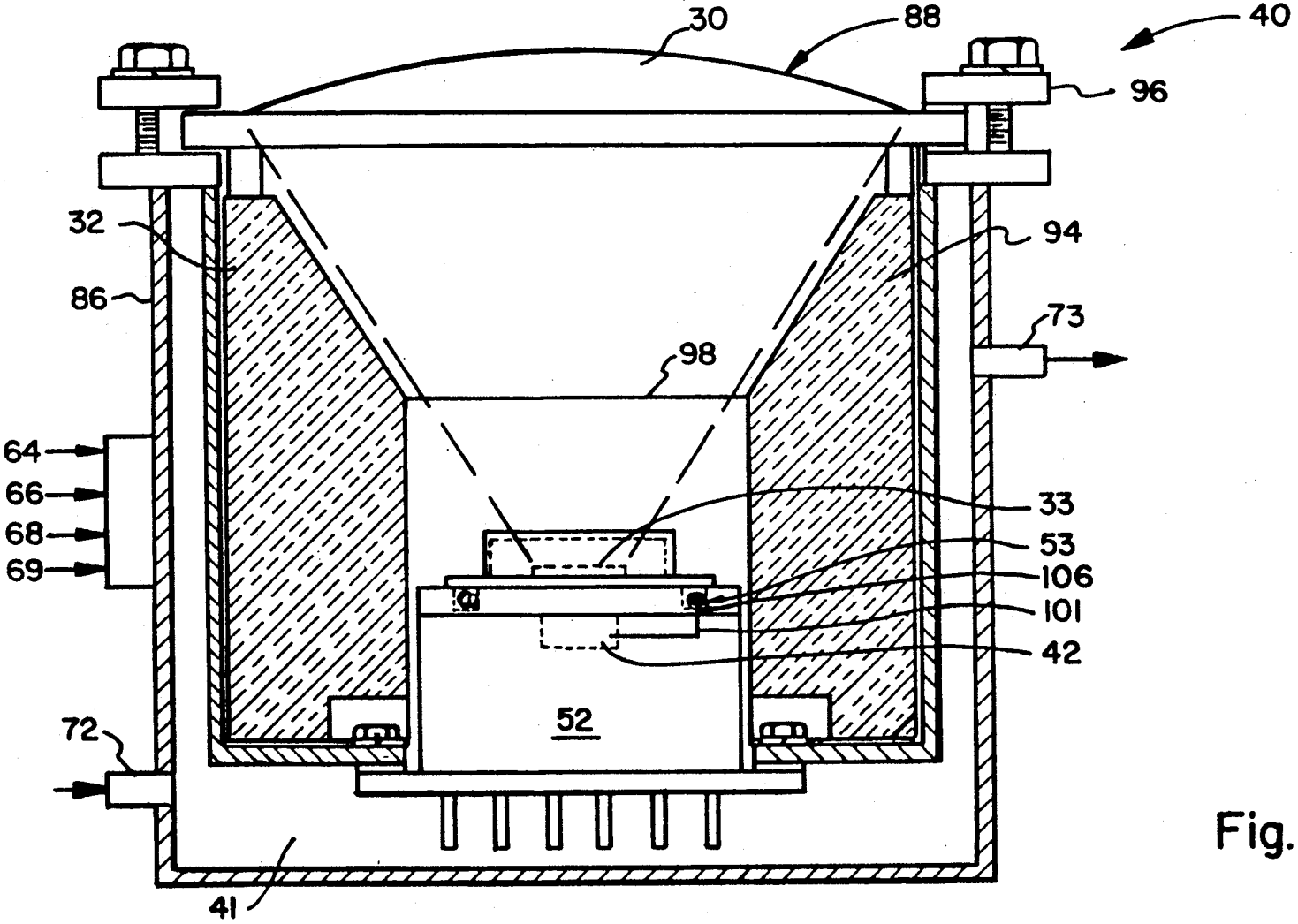
FIG. 5 is an enlarged, cross-sectional view of a sensor head assembly, taken along line 5—5 of FIG. 4.

In accordance with the invention, the temperature of the sensor 32 within a sensor head assembly 40, shown in FIG. 5, is kept within a narrow desirable range by using a suitable combination of heating and cooling gases, electric heating means, and thermoelectric cooling means. The sensor head assembly 40 incorporates the sensor 32 which has a temperature detector 42 mounted thereon. A thermoelectric cooler 52 and an electric resistance heater 53 are mounted proximate the temperature detector 42. A vortex tube 46 is mounted on the preheater 10 external to the sensor head assembly 40. The vortex tube 46, which takes a stream of compressed air and separates it into a hotter stream 48 and a cooler stream 50, supplies heating, or additional cooling to the sensor head assembly 40. When the detector 42 is too hot, the thermoelectric cooler 52 cools the detector 42. If the temperature of the detector 42 remains too high, i.e., the temperature inside the air jacket 41 for cooling or heating air, located below the lead sulfide chip, is too high, the cooler stream 50 of the vortex tube is used as a supplementary source to cool the detector 42. Cooling air enters the sensor head assembly 40 through air inlet line 72, and exits through air outlet line 73. On the other hand, when the detector 42 temperature is too cool, the electric heater 53 is activated. If the amount of heat delivered by the electric heater 53 is inadequate to sufficiently heat the detector 42, additional heating is supplied by the hotter stream 48 of the vortex tube 46 through air inlet line 72 and exits the sensor head assembly 40 through air outlet line 73. It is noted that the electric heater 53 can be eliminated from the apparatus if the hotter stream 48 of the vortex tube 46 can alone provide sufficient heat.

As illustrated in FIG. 4, the sensor head assembly 40 is supported by the conduit 34. Line 64 transports an electric signal from the detector 42 in the sensor head assembly 40 to the signal processor 70. The output from signal processor 70 includes a signal indicative of the temperature T, which is the temperature of the PbS chip. Line 66 transports electric power to the thermoelectric cooler 52 and electric heater 53. Lines 68 and 69 deliver the hot compressed air stream 48 and cold compressed air stream 50, respectively, to the air inlet line 72 of the sensor head assembly. Lines 64, 66, 68 and 69 pass through a rotating joint 63 which allows the conduit 34 to traverse the arcuate path shown in FIG. 3 without twisting the lines.

The control of the thermoelectric cooler 52, the electric heater 53 and the vortex tube 46 via control signals C1 and C2 is accomplished by the logic in controller 82. As shown in further detail in FIG. 6, controller 82 includes a temperature controller 83, which controls a heating controller 85 and a cooling controller 87, which in turn control the heating and cooling of the temperature detector. The input T to the controller 82 is a signal indicative of the temperature sensed by the temperature detector mounted on the infrared detector, and is transferred through signal line 84.

As shown in FIG. 5, the sensor head assembly 40 has a casing 86 having three main parts: the lens subassembly 88, transducer subassembly 90 and jacket 41. While the same type of jacket as is used in a conventional water-cooled detector can be used according to the invention, the jacket 41 need not be as tightly sealed as a cooling water jacket, as leakage of air will not cause problems. Furthermore, a smaller jacket can be used according to this invention than is used in a conventional temperature control system.

The lens subassembly includes a lens 30, a lens mount 94 and a connector cap 96. The transducer subassembly includes a sensor package 98, a signal lead 100 between the sensor package 98 and the thermoelectric cooler 52, a signal lead 101 between the sensor package 98 and an electric heater 53, and the lines 64,66,68,69 which enter the transducer subassembly through conduit 34, shown in FIG. 4.

The electric heater 53 includes a plurality of resistance heaters or the like 106, which surround the sensor package 98 and can selectively increase the temperature of the sensor 32. The heaters are in the lower portion of the transducer subassembly proximate the lead sulfide chip, as shown in FIG. 5.

As shown in FIG. 5, the air inlet line 72 opens up into the air jacket 41 which surrounds the cooling fins. Compressed air at a relatively cold temperature can be directed around the sensor package 98 and through air outlet line 73, thereby cooling the package selectively. The lines 64 and 66 enter the package 98 in a conventional manner for providing whatever power is required therein, and handle the signals generated therein as a consequence of the changes processed in the package resulting from signals received from the controller 82.

Figure 6:
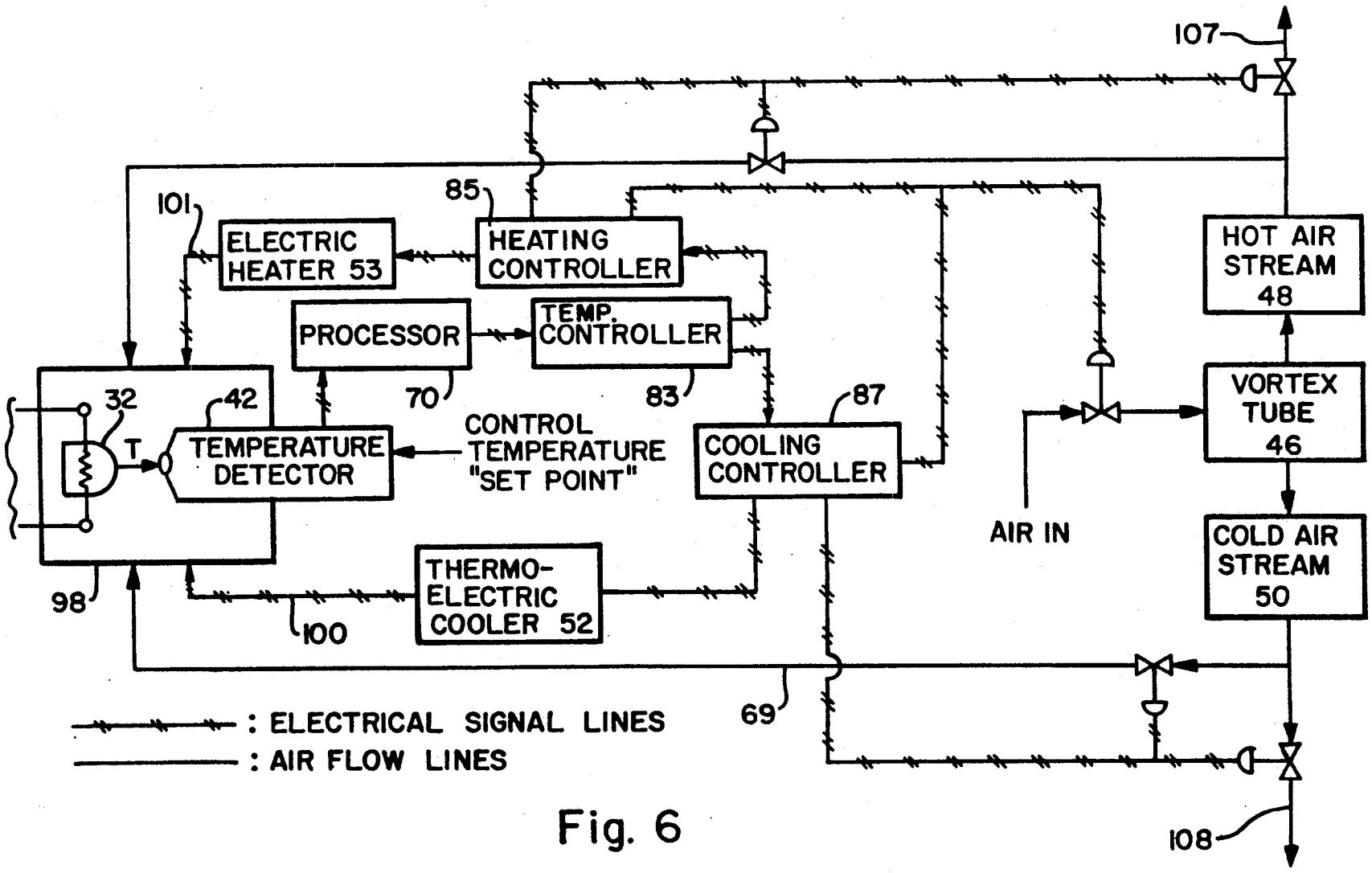
FIG. 6 is a schematic diagram of the control logic for the temperature control system shown in FIG. 4.

Referring now to FIG. 6, the logic by which each of the hot air stream 48 and cold air stream 50 is actuated alone, or in combination with, one of the thermoelectric cooler 52 and electric heater 53, in order to control the temperature in the sensor head assembly 40, is as follows. When the temperature of the sensor 32, which is detected by the detector 42, exceeds the control temperature, the thermoelectric cooler 52 is actuated to maintain the sensor temperature. If the temperature cannot be kept constant, air is supplied to the vortex tube 46, and the cold air stream 50 of the vortex tube 46 is opened to supply cold air through line 69. This air cools the cooling fins and enables the thermoelectric cooler 52 to increase its cooling capacity. The power to the thermoelectric cooler 52 is regulated by the temperature of the sensor 32. When the temperature of the sensor 32 is less than the desired control temperature, power is supplied to the electric heater53. The power is regulated by the temperature of the sensor 32. If sufficient heating cannot be provided, air is supplied to the vortex tube 46, and the hot air stream 48 of the vortex tube 46 is opened to supply hot air to the air cavity below the lead sulfide chip. This additional heating will maintain the sensor 32 at the control temperature. Hot air and cold air that is generated but is not used passes along hot air line 107 and cold air line 108.

As will be apparent to persons skilled in the art, various modifications and adaptations of the structure above described will become readily apparent without departure from the spirit and scope of the invention, the scope of which is defined in the appended claims.

I claim:

1. A control system for regulating the temperature of a heat detector disposed on a rotary regenerative heat exchanger to within a predetermined temperature range defined by a maximum temperature and a minimum temperature, comprising:

temperature sensing means for sensing the temperature of the detector, non-liquid cooling means for cooling the detector to within the predetermined temperature range when the temperature of the detector is above the maximum temperature, the non-liquid cooling means including one of thermoelectric cooling means and a combination of thermoelectric cooling means and cool compressed gas means, non-liquid heating means for heating the detector to within the predetermined temperature range when the temperature of the detector is below the minimum temperature, the non-liquid heating means including electrical resistance heating means, and control means coupling the temperature sensing means to the non-liquid heating means and the non-liquid cooling means, for activating the non-liquid cooling means when the temperature of the detector is above the maximum temperature and activating the non-liquid heating means when the temperature of the detector is below the minimum temperature.

2. A control system according to claim 1, wherein the cool compressed gas means comprises cool air means.

3. A control system according to claim 1, wherein the non-liquid heating means further comprises hot compressed gas means.

4. A control system according to claim 3, wherein the hot compressed gas means comprises hot compressed air means.

5. An apparatus for detecting a hot spot in a rotary regenerative heat exchanger, comprising:

heat exchanger temperature sensing means for sensing whether a portion of the heat exchanger has a temperature exceeding a threshold value, a control system for maintaining the temperature of the heat exchanger temperature sensing means within a predetermined temperature range defined by a maximum temperature and a minimum temperature, the control system including means for determining the temperature of the heat exchanger temperature sensing means, non-liquid cooling means for cooling the heat exchanger temperature sensing means to within the predetermined temperature range when the temperature of the heat exchanger temperature sensor means is above the maximum temperature, the non-liquid cooling means including one of thermoelectric cooling means and a combination of thermoelectric cooling means and cool compressed gas means, non-liquid heating means for heating the heat exchanger temperature sensing means to within the predetermined temperature range when the temperature of the heat exchanger temperature sensor means is below the minimum temperature, the non-liquid heating means including electrical resistance heating means, and control means coupling the means for determining the temperature of the heat exchanger temperature sensing means to the non-liquid heating means and the non-liquid cooling means, the control means activating the non-liquid cooling means when the temperature of the heat exchanger temperature sensing means is above the maximum temperature and activating the non-liquid heating means when the heat exchanger temperature sensing means is below the minimum temperature.

6. An apparatus according to claim 5, wherein the cool compressed gas means comprises cool air means.

7. An apparatus according to claim 5, wherein the non-liquid heating means further comprises hot compressed gas means.

8. An apparatus according to claim 7, further comprising jacket means for containing the hot and cool compressed gas means.

9. An apparatus according to claim 7, wherein the hot compressed gas means comprises hot compressed air means.

10. An apparatus according to claim 5, wherein the non-liquid cooling means includes a combination of thermoelectric cooling means and cool compressed gas means, the apparatus further comprising jacket means for containing the cool compressed gas means.

11. A method for regulating the temperature of a heat detector disposed on a rotary regenerative heat exchanger to within a minimum temperature, comprising:

sensing the temperature of the detector using temperature sensing means, and adjusting the temperature of the detector using a control means coupling the temperature sensing means to heating means including electrical resistance heating means for heating the detector and cooling means including one of thermoelectric and a combination of thermoelectric and compressed gas cooling means for cooling the detector, the control means activating the cooling means when the temperature of the detector is above the maximum temperature and activating the heating means when the temperature of the detector is below the minimum temperature.

12. A method according to claim 11, wherein the adjusting step further comprises using heating means including hot compressed gas means.

13. A method according to claim 12, wherein the hot compressed gas means comprises hot compressed air means.

14. A method for detecting the temperature of a portion of a rotary regenerative heat exchanger, comprising:

sensing the temperature of the portion of the heat exchanger using a radiation detector to determine whether a portion of the heat exchanger has a temperature exceeding a threshold value, wherein the temperature of the radiation detector is maintained within a predetermined temperature range defined by a maximum temperature and a minimum temperature by the steps of:

sensing the temperature of the detector, and adjusting the temperature of the detector using a control means coupling the temperature sensing means to a non-liquid heating means including electrical resistance heating means for heating the detector and a non-liquid cooling means including one of thermoelectric cooling means and a combination of thermoelectric cooling means and cool compressed gas means for cooling the detector, the control means activating the non-liquid cooling means when the temperature of the detector is above the maximum temperature and activating the non-liquid heating means when the temperature of the detector is below the minimum temperature.

15. A method according to claim 14, wherein the adjusting step further comprises using heating means including hot compressed gas means.

* * * * *

UNITED STATES PATENT AND TRADEMARK OFFICE

CERTIFICATE OF CORRECTION

PATENT NO. : 5,213,152

DATED : May 25, 1993

INVENTOR(S) : William C. Cox

It is certified that error appears in the above-indentified patent and that said Letters Patent is hereby corrected as shown below:

Claim 11, column 7, line 3, delete "minimum" and insert --predetermined-- and after "temperature" insert --range defined by a maximum temperature and a minimum temperature--.

Signed and Sealed this

Twenty-seventh Day of December, 1994

*Attest:*

Bruce Lehman

BRUCE LEHMAN

*Attesting Officer*

*Commissioner of Patents and Trademarks*